US007822365B2

(12) United States Patent
Iwamoto

(10) Patent No.: US 7,822,365 B2
(45) Date of Patent: Oct. 26, 2010

(54) IMAGE FORMING APPARATUS

(75) Inventor: Kazuyuki Iwamoto, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 11/739,200

(22) Filed: Apr. 24, 2007

(65) Prior Publication Data

US 2007/0248387 A1 Oct. 25, 2007

(30) Foreign Application Priority Data

Apr. 25, 2006 (JP) ..... 2006-120074

(51) Int. Cl.
*G03G 15/01* (2006.01)

(52) U.S. Cl. ..... 399/179; 399/299

(58) Field of Classification Search ..... 399/121, 399/298, 299, 302, 308, 179, 192, 199–202; 347/134, 137

See application file for complete search history.

(56) References Cited

U.S. PATENT DOCUMENTS

| | | | | |
|---|---|---|---|---|
| 6,757,512 | B2 | 6/2004 | Miyawaki et al. | 399/299 |
| 7,203,452 | B2 | 4/2007 | Miyawaki et al. | 399/299 |
| 7,619,642 | B2 * | 11/2009 | Matsuyama et al. | 347/118 |
| 2003/0099492 | A1 * | 5/2003 | Maeyama et al. | 399/302 |
| 2004/0051771 | A1 * | 3/2004 | Eom et al. | 347/134 |
| 2005/0019064 | A1 * | 1/2005 | Sato et al. | 399/298 |
| 2007/0134026 | A1 * | 6/2007 | Sato et al. | 399/299 |
| 2007/0248386 | A1 * | 10/2007 | Uduki | 399/299 |

FOREIGN PATENT DOCUMENTS

| | | |
|---|---|---|
| JP | 2001-51472 A | 2/2001 |
| JP | 2002-162807 A | 6/2002 |

* cited by examiner

*Primary Examiner*—David M Gray
*Assistant Examiner*—Gregory H Curran
(74) *Attorney, Agent, or Firm*—Fitzpatrick, Cella, Harper & Scinto

(57) ABSTRACT

The present invention relates to an image forming apparatus comprising: a plurality of image forming means; a first image forming means; a second image forming means; a belt member to be transferred with the toner image formed on each image forming means; and a plurality of suspending members, wherein said plurality of image forming means are arranged so as to face to a first belt surface between the suspending members; the first and second image forming means are arranged so as to face to a second belt surface different from the first belt surface; and a distance, between adjacent contact portions of the image forming means on the second belt surface side and said second belt surface, is greater than a distance, between adjacent contact portions of the image forming means on the first belt surface side and said first belt surface.

9 Claims, 6 Drawing Sheets

IMAGE FORMING APPARATUS

BACKGROUND OF THE INVENTION

1. Field of the invention

The present invention relates to an image forming apparatus which includes a plurality of image forming means and performs image formation using an endless belt member.

2. Description of the related art

A tandem color image forming apparatus, including independent image forming portions with respect to each color of yellow, magenta, cyan, and black, for forming a color image using an intermediate transfer belt of an endless belt member is known as the conventional color image forming apparatus. In image formation, a photosensitive member of each image forming portion is exposed to laser light to form an electrostatic latent image, which electrostatic latent image is then developed with the toner of each color, and the obtained toner image is transferred so as to be sequentially superimposed on the intermediate transfer belt. Subsequently, the superimposed toner images on the intermediate transfer belt are transferred onto a sheet-like recording material all together, and a color image is obtained.

Most of such tandem color image forming apparatus have a configuration in which independent image forming portions are arranged with respect to each color of yellow, magenta, cyan, and black in a line along the rotating direction of the intermediate transfer belt. However, if such image forming portions are arranged in a line, the length of the intermediate transfer belt becomes long, and the color image forming apparatus increase in size along the intermediate transfer belt.

Japanese Patent Application Laid-Open No. 2001-51472 and Japanese Patent Application Laid-Open No. 2002-162807 thus propose to evenly distribute and arrange the image forming portions including the photosensitive member and the like on the opposing outer peripheral surfaces of the intermediate transfer belt to reduce the length of the intermediate transfer belt, and miniaturize the color image forming apparatus.

Higher image quality is being demanded on the tandem color image forming apparatus. Image formation is desirably performed using accessory colors such as light magenta having the same hue as magenta but a weaker concentration, light cyan having the same hue as cyan but a weaker concentration in addition to each basic color of yellow, magenta, cyan and black.

Therefore, when more than four colors are used to form the image, the length of the intermediate transfer belt becomes longer and the color image forming apparatus enlarges along the intermediate transfer belt if the photosensitive members are arranged in a line along the rotating direction of the intermediate transfer belt as in the prior art.

A method of evenly distributing and arranging the image forming portions on the opposing outer peripheral surfaces of the intermediate transfer belt as described in the configuration of the above-mentioned documents is thus considered. In this case, however, the basic colors of yellow, magenta, cyan and black, which are used very often in forming the color image, are distributed and arranged on different surfaces of the transfer belt, and thus the tensile force of the belt at the respective surface tends to differ, which may easily cause color shift. Superimposing the toner images with the basic colors on the same surface of the transfer belt is effective to prevent color shift.

In a configuration in which the basic colors are collected on the same one surface of the transfer belt, however, the spacing between the photosensitive drums, that is, the spacing in the width direction of the image forming apparatus needs to be narrowed, and furthermore, the size of the image forming portion in the width direction needs to be reduced in order to narrow the width of the image forming apparatus. The size in the height direction of the image forming portion must be increased if the size in the width direction of the image forming portion is reduced, and thus the height of the image forming apparatus increases as a result.

Therefore, if the spacing between the photosensitive drums of the accessory colors is made to the same size as the basic color side regardless of the fact that the space in the width direction is greater compared to the basic color side at the surface arranged with the accessory colors fewer than the basic colors, the height of the image forming apparatus increases in order to ensure the optical length of the laser light.

SUMMARY OF THE INVENTION

An object of the present invention is to provide an image forming apparatus for enhancing the degree of freedom of arrangement of the image forming means of the accessory colors while preventing color shift of the basic colors, and reducing the height of the image forming apparatus.

Another object of the present invention is to provide an image forming apparatus including:

a plurality of image forming means which forms a toner image using toners of colors of black, cyan, magenta, yellow;

a first image forming means which forms a toner image on an image bearing member using a toner of first accessory color different from the colors;

a second image forming means which forms a toner image on an image bearing member using a toner of second accessory color different from the colors;

a belt member to be transferred with the toner image formed on each image forming means; and a plurality of suspending members which suspend the belt member, wherein said plurality of image forming means are arranged so as to face to a first belt surface between the suspending members;

the first and second image forming means are arranged so as to face to a second belt surface different from the first belt surface; and a distance, between adjacent contact portions of the image forming means on the second belt surface side and said second belt surface, is greater than a distance, between adjacent contact portions of the image forming means on the first belt surface side and said first belt surface.

Further still another object of the present invention should become apparent from the following description.

DETAILED DESCRIPTION OF THE PREFERRED EMBODIMENTS

The exemplary embodiments of the present invention will now be illustrated in detail with reference to the drawings. The dimensions, materials, shapes, relative arrangement and the like of the components described in the following embodiment can be appropriately changed depending on the configuration and various conditions of the apparatus to which the present invention is applied. Therefore, unless specifically stated, the scope of the present invention should not be recognized as being limited thereto.

A tandem color image forming apparatus (printer) is illustrated and described as the image forming apparatus.

Figure 1:
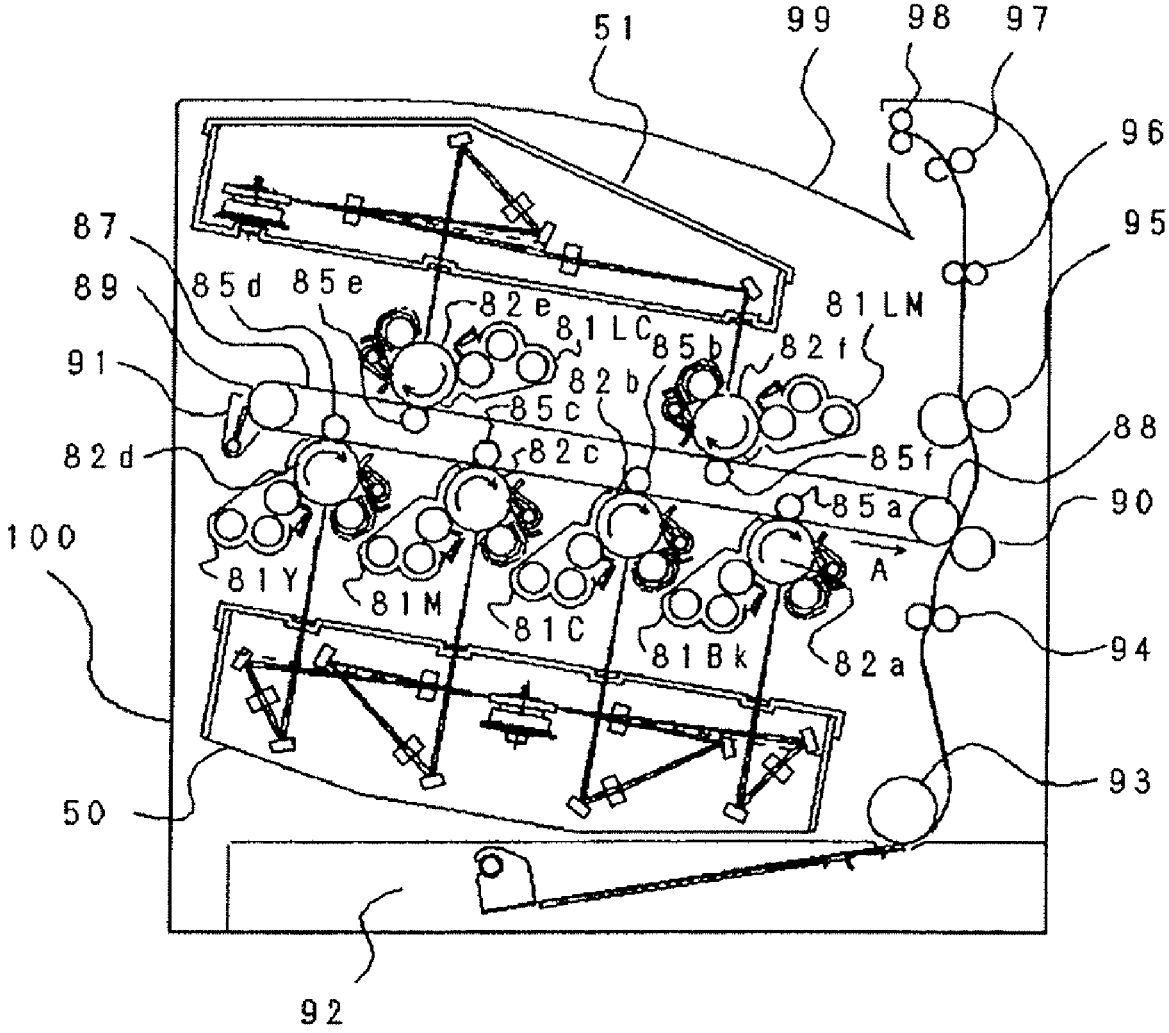
FIG. 1 is a schematic cross-sectional view of a tandem color printer.
Figure 2:
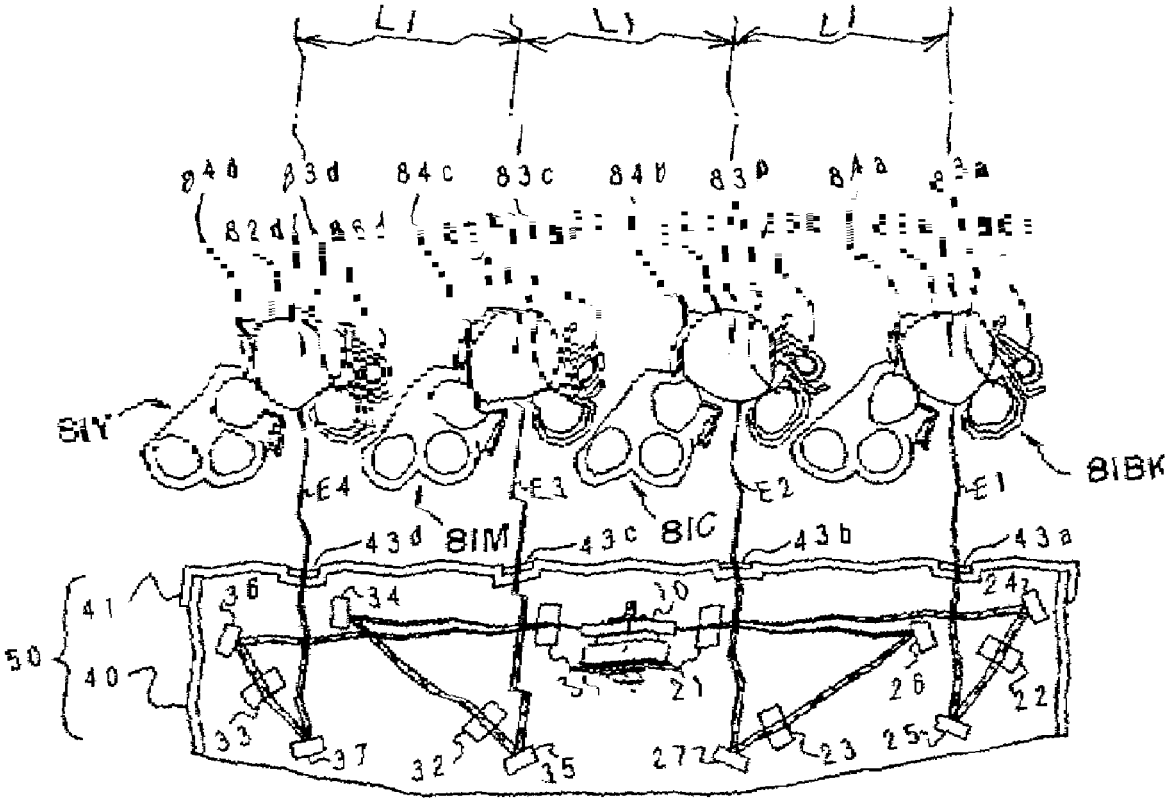
FIG. 2 is a schematic cross-sectional view illustrating a scanning optical device and an image forming portion on the lower side of a belt.
Figure 3:
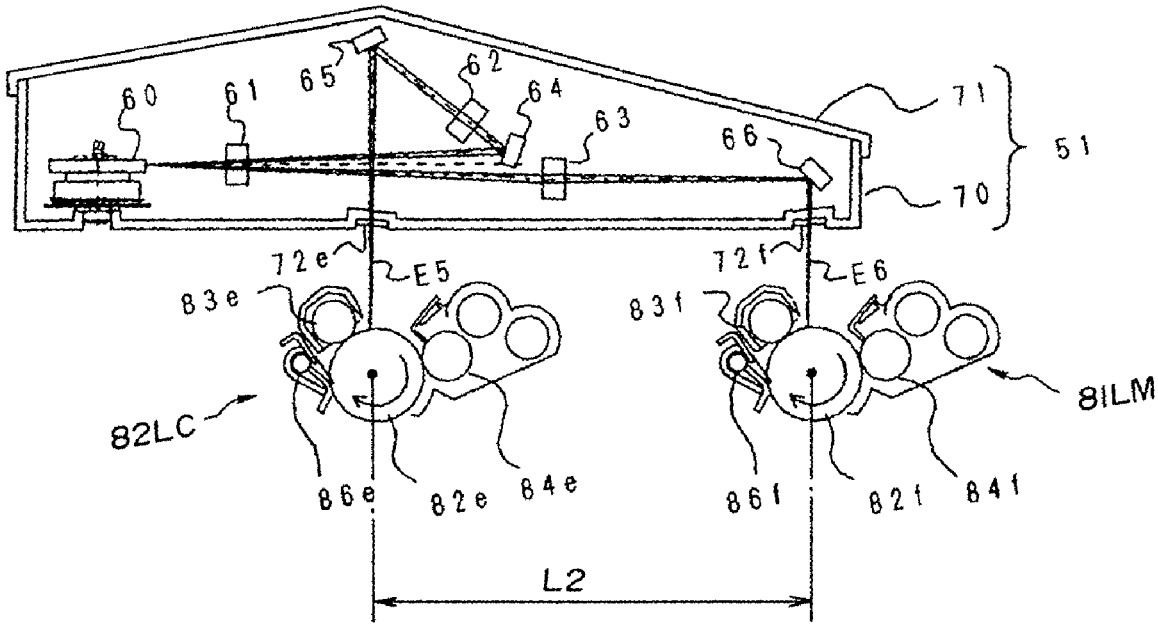
FIG. 3 is a schematic cross-sectional view illustrating a scanning optical device and an image forming portion on the upper side of the belt.
Figure 4:
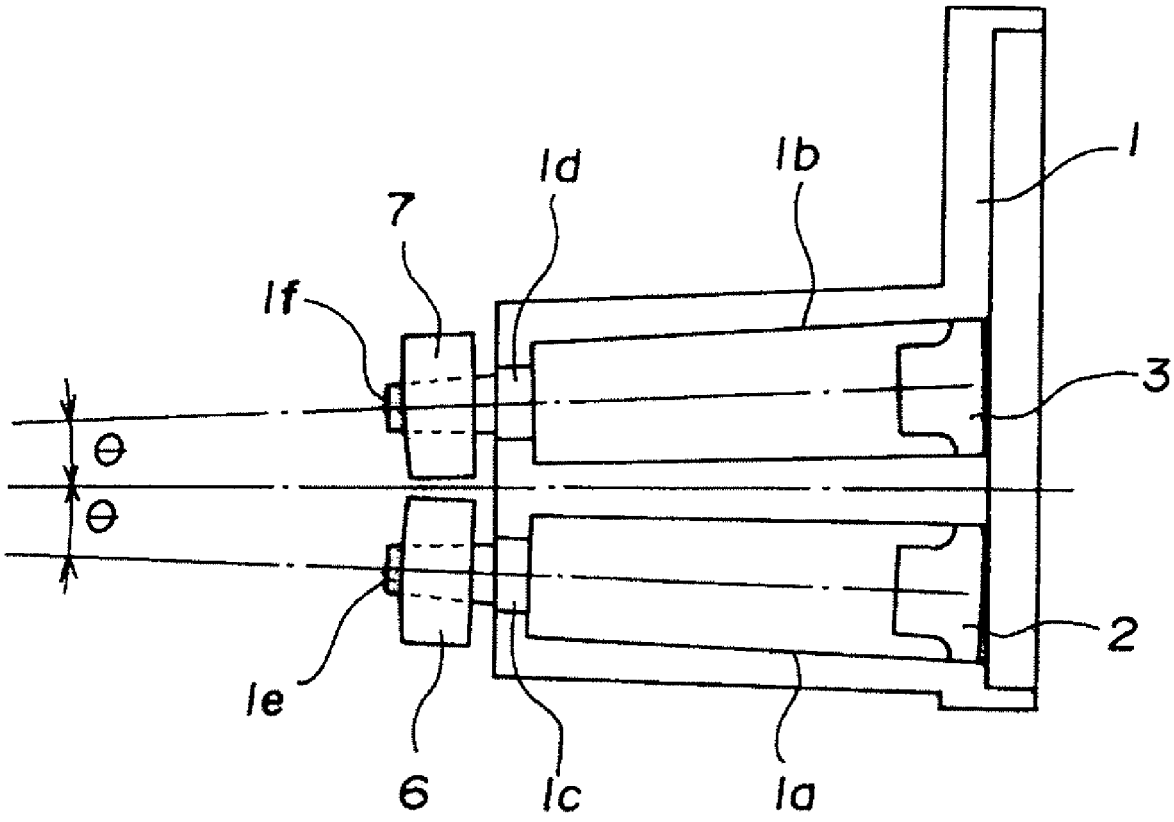
FIG. 4 is a cross-sectional view of a laser holder portion.
Figure 5:
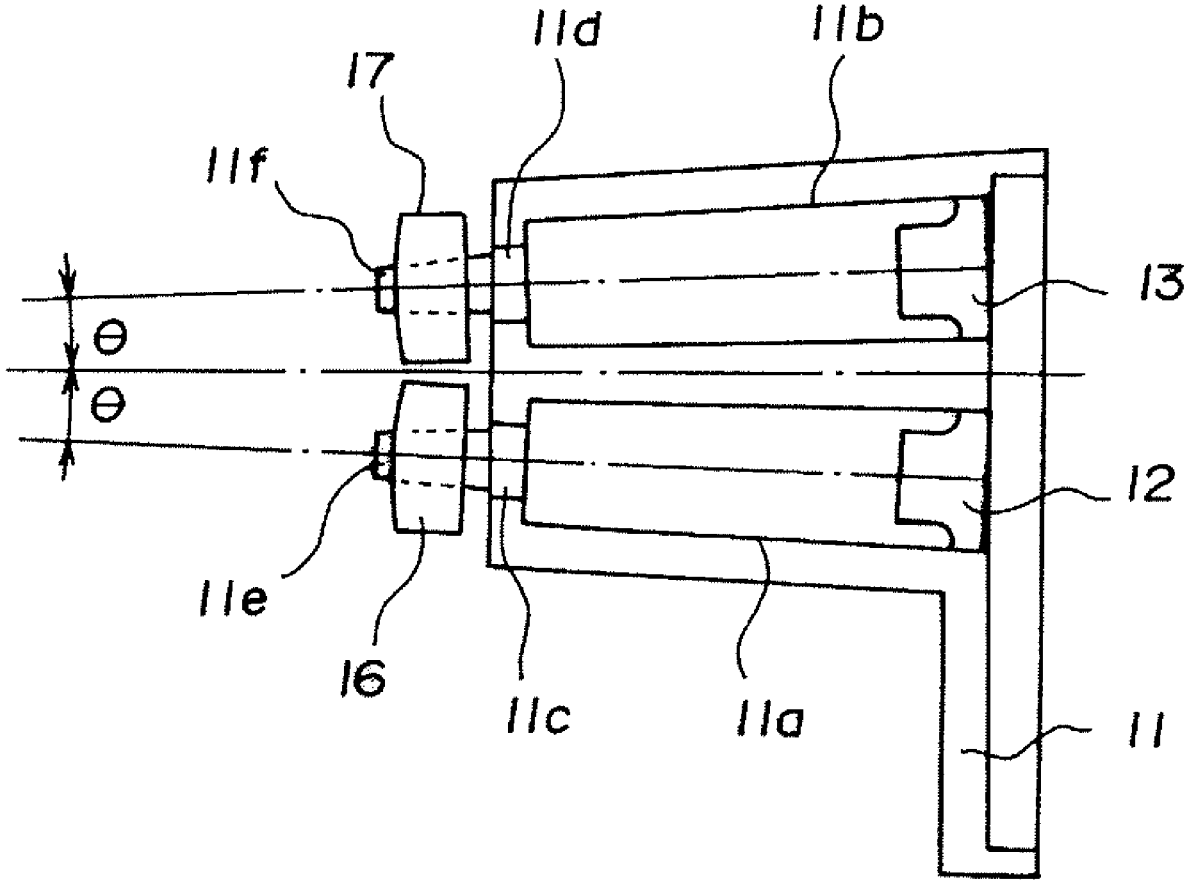
FIG. 5 is another cross-sectional view of the laser holder portion.

FIG. 1 is a schematic cross-sectional view of a tandem color printer of one embodiment of the present invention, FIGS. 2 and 3 are schematic cross-sectional views illustrating a scanning optical device and image forming means, and FIGS. 4 and 5 are cross-sectional views of a laser holder portion.

As shown in FIG. 1, the color printer 100 includes an intermediate transfer belt (intermediate transfer member) 87 serving as an endless belt member. The intermediate transfer belt 87 is stretched between belt conveyance rollers 88, 89 serving as a plurality of rotating bodies, and has two opposing flat outer peripheral surfaces. Regarding the two opposing flat outer peripheral surfaces of the intermediate transfer belt 87, one surface side is the upper surface side of the apparatus, and the other surface side is the bottom surface side of the apparatus.

The color printer 100 also includes first to fourth image forming means for forming images of different colors. An image forming means 81Bk for forming an image of black color, an image forming means 81C for forming an image of cyan color, an image forming means 81M for forming an image of magenta color, and an image forming means 81Y for forming an image of yellow color are arranged in the named order. Therefore, image forming means for forming the toner images of the basic colors of black, cyan, magenta, and yellow are thus arranged. Fifth and sixth image forming portions for forming the toner images of accessory colors are further arranged. An image forming portion 81LC for forming an image of light cyan color having the same hue as cyan but weaker concentration, and an image forming portion 81LM for forming an image of light magenta color having the same hue as magenta but weaker concentration are also arranged, and thus six image forming portions (image forming units) are arranged in the named order.

In the color printer 100, the six image forming portions are arranged on the two opposing flat outer peripheral surfaces of the intermediate transfer belt 87. Furthermore, the number of image forming portions arranged on the one surface side is fewer than the number of image forming portions arranged on the other surface side. Specifically, the image forming portions 81Bk, 81C, 81M and 81Y of the six image forming portions are arranged at a constant interval on the lower side of the intermediate transfer belt 87 in a line. The image forming portions 81Bk, 81C, 81M and 81Y are slanted with respect to the installing surface of the color printer 100 in a state that the image forming portion 81Bk is the closest to the installing surface. In the present exemplary embodiment, the outer diameters of the photosensitive drums serving as image bearing members of the image forming portions are all 30 mm. There is a constant interval between the rotating axes of the photosensitive drums. The image forming portions for forming the toner images of the basic colors are arranged on the same belt surface between the rotating bodies (suspending members), thereby reducing the influence of the tensile force of the belt and preventing color shift. The image forming portions 81LC, 81LM are arranged at a wider interval than the image forming portions 81Bk, 81C, 81M, 81Y on the upper side of the intermediate transfer belt 87.

A drum type image bearing member (hereinafter referred to as photosensitive drum) 82*a*, 82*b*, 82*c*, 82*d*, 82*e*, 82*f* are respectively arranged on each image forming portion 81Bk, 81C, 81M, 81Y, 81LC, 81LM. As shown in FIGS. 1 to 3, processing units that act on the photosensitive drums are arranged at the periphery of each photosensitive drum 82*a*, 82*b*, 82*c*, 82*d*, 82*e*, 82*f*. Specifically, primary chargers 83*a*, 83*b*, 83*c*, 83*d*, 83*e*, 83*f*, developing devices 84*a*, 84*b*, 84*c*, 84*d*, 84*e*, 84*f*, transfer rollers serving as transfer units 85*a*, 85*b*, 85*c*, 85*d*, 85*e*, 85*f* and drum cleaner devices 86*a*, 86*b*, 86*c*, 86*d*, 86*e*, 86 are arranged as the processing units. A scanning optical device 50 serving as a first exposure unit is installed on the lower side between the primary chargers 83*a*, 83*b*, 83*c*, 83*d* and the developing devices 84*a*, 84*b*, 84*c*, 84*d*. In the present exemplary embodiment, one image forming portion is an image forming unit including the photosensitive drum, the primary charger, the developing device, and the drum cleaner device, and is detachably attachable with respect to the image forming apparatus. A scanning optical device 51 serving as a second exposure unit is installed on the upper side between the primary chargers 83*e*, 83*f* and the developing devices 84*e*, 84*f*.

The adjacent image forming portions are arranged in a superimposed manner in a range so that the exposure to the photosensitive member is not inhibited so as to have the interval among the photosensitive drums 82*a*, 82*b*, 82*c*, and 82*d* arranged on the lower side of the intermediate transfer belt as small as possible. Specifically, the developing devices 84*a*, 84*b*, 84*c*, and 84*d* are arranged so as to be partially superimposed in the vertical direction on the lower side of the primary chargers 83*a*, 83*b*, 83*c*, and 83*d*. The occupying space of the image forming portion thus does not enlarge in the left and right width direction and the color printer 100 can be miniaturized. The intervals among the photosensitive drums 82*a*, 82*b*, 82*c*, and 82*d* is set to be equal in the present exemplary embodiment.

As described above, the interval between the photosensitive drums 82*e*, 82*f* arranged on the upper side of the intermediate transfer belt is wider than the intervals among the photosensitive drums 82*a*, 82*b*, 82*c*, and 82*d* arranged on the lower side of the intermediate transfer belt. The primary chargers 83*e*, 83*f* and the developing devices 84, 84*f* thus can be arranged so as not to be superimposed in the vertical direction. The occupying space of the image forming portion thus does not enlarge in the vertical height direction and the color printer 100 can be miniaturized. Since the developing devices on the accessory color side can be widened in the width direction of the image forming apparatus compared to the developing devices on the basic color side, the height of the developing device on the accessory color side can be reduced. Furthermore, the scanning optical device 51 can be arranged close to the photosensitive drums 82*e*, 82*f*, and the degree of freedom of arrangement can be enhanced, whereby the color printer 100 can be further miniaturized without being enlarged in the vertical height direction. The spacing between the photosensitive drums is the center distance of the photosensitive drums or the distance between the contacting portions of the image bearing member and the intermediate transfer belt if the image bearing member is other than the photosensitive drum.

In the present embodiment, the intervals among the photosensitive drums 82*a*, 82*b*, 82*c*, and 82*d* are set to be the same as the peripheral length of the photosensitive drums. Furthermore, the spacing L2 of the photosensitive drums 82*e*, 82*f* is set to be twice the spacing L1 of the photosensitive drums 82*a*, 82*b*, 82*c*, and 82*d*, that is, to integral multiples of the peripheral length of the photosensitive drum. Therefore, the influence of rotational unevenness caused by the drum, which is one cause of occurrence of color shift, can be eliminated, the color shift is reduced and higher image quality is achieved.

Black toner, cyan toner, magenta toner, yellow toner, light cyan toner, and light magenta toner are respectively stored in each developing device 84*a*, 84*b*, 84*c*, 84*d*, 84*e*, and 84*f*.

Each photosensitive drum 82*a*, 82*b*, 82*c*, 82*d*, 82*e*, 82*f* includes a photo-conducting layer on an aluminum drum base of negatively charged OPC photosensitive member. Each photosensitive drum 82*a*, 82*b*, 82*c*, 82*d*, 82*e*, 82*f* is rotatably driven at a predetermined processing speed in the direction of the arrow (clockwise direction in FIG. 1) by a driving device (not shown).

Each primary charger 83*a*, 83*b*, 83*c*, 83*d*, 83*e*, 83*f* serving as the primary charging unit evenly charges the surface of each photosensitive drum 82*a*, 82*b*, 82*c*, 82*d*, 82*e*, and 82*f* to a predetermined potential of negative polarity by a charging bias applied from a charging bias power supply (not shown).

Each developing device 84*a*, 84*b*, 84*c*, 84*d*, 84*e*, 84*f* incorporates the toner, and attaches the toner of each color on each electrostatic latent image formed on each photosensitive drum 82*a*, 82*b*, 82*c*, 82*d*, 82*e*, 82*f* to develop the toner image (visible image).

Each transfer roller 85*a*, 85*b*, 85*c*, 85*d*, 85*e*, and 85*f* serving as a transfer unit contacts each photosensitive drum 82*a*, 82*b*, 82*c*, 82*d*, 82*e*, 83*f* byway of the intermediate transfer belt 87 at each primary transfer nip portion.

Each drum cleaner device 86*a*, 86*b*, 86*c*, 86*d*, 86*e* and 86*f* is configured by a cleaning blade and the like for removing residual toner remaining in the time of primary transfer on the photosensitive drum from the photosensitive member.

The intermediate transfer belt 87 is stretched between a pair of belt conveyance rollers (first suspending member, second suspending member) 88, 89, and is rotated (moved) in the direction of the arrow A (counterclockwise direction in FIG. 1). The intermediate transfer belt 87 is made of dielectric resin such as polycarbonate, polyethylene terephthalate resin film, and polyvinylidene fluoride resin film. The number of rotating bodies for stretching the intermediate transfer belt 87 is not limited to the above pair.

The belt conveyance roller 88 contacts a secondary transfer roller 90 by way of the intermediate transfer belt 87, to form a secondary transfer portion. The belt cleaning device 91 for removing and collecting the transfer residual toner remaining on the surface of the intermediate transfer belt 87 is arranged in the vicinity of the belt conveyance roller 89 on the exterior side of the intermediate transfer belt 87.

A sheet cassette 92 stores sheet-like recording materials. The recording material in the sheet cassette 92 is fed one at a time by a sheet feeding roller 93 and conveyed to a registration roller paper 94, and then stopped once, and again conveyed at a timing the toner image is transferred to a predetermined position at the secondary transfer portion. The recording material transferred with the toner image at the secondary transfer portion is fixed with the toner image with heat by means of a fixing portion 95, and then conveyed and discharged onto a discharge tray 99 by conveyance roller pairs 96, 97, and paper discharging roller pair 98.

In the scanning optical device 50, a laser holder 1 presses into semiconductor lasers (single beam laser) 2, 3 serving as light sources to lens barrel holding portions 1*a*, 1*b* and holds the semiconductor lasers, as shown in FIG. 4. The lens barrel holding portions 1*a*, 1*b* are arranged with an optical axis inclined so that the optical paths of the semiconductor lasers 2, 3 intersect with each other in the vicinity of a polygon mirror 10 at a predetermined angle θ in a sub-scanning direction, and one part of the outline of the lens barrel is integrated. Therefore, the semiconductor lasers 2, 3 can be held at a close spacing. Aperture portions 1*c*, 1*d* corresponding to semiconductor lasers 2, 3 are arranged at the distal end side of the lens barrel holding portions 1*a*, 1*b*, respectively so that the beams exited from the semiconductor lasers 2, 3 are shaped into a desired suitable beam shape. Adhering portions 1*e*, 1*f* of collimator lenses 6, 7 for converting each beam that has passed the aperture portions 1*c*, 1*d* to a substantially parallel beam are arranged at two locations, respectively, in the main scanning direction at the further distal end of the lens barrel holding portions 1*a*, 1*b*. The collimator lenses 6, 7 adjust the irradiating position or the focus while detecting the optical characteristic of the laser light, and are adhered and fixed to the adhering portions 1*e*, 1*f* by irradiating ultraviolet ray on the ultraviolet curable adhesive after the positions are determined.

An optical case 40 accommodates each optical component of the scanning optical device. A fit-in hole portion and a long hole portion for positioning the laser holder 1 are arranged in the sub-scanning direction at the side wall of the optical case 40, so that the fit-in portion arranged on the external part of the lens barrel holding portions 1*a*, 1*b* is fitted and attached thereto. Therefore, the laser holder 1 is attached to the optical case 40 by fitting the fit-in portion arranged on the external part of the lens barrel holding portions 1*a*, 1*b* for holding the semiconductor lasers 2, 3 and forming the optical paths. The positional relationship between the semiconductor lasers 2, 3 and each optical component accommodated in the optical case 40 is thereby guaranteed to be at satisfactory precision.

As shown in FIG. 5, a laser holder 11 which is a component similar to the laser holder 1, presses into the semiconductor lasers 12, 13 to the lens barrel holding portions 11*a*, 11*b* and holds the semiconductor lasers. The lens barrel holding portions 11*a*, 11*b* are arranged with an optical axis inclined so that the optical paths of the semiconductor lasers 12, 13 intersect with each other in the vicinity of a polygon mirror 10 at a predetermined angle θ in a sub-scanning direction, and one part of the outline of the lens barrel is integrated. Aperture portions 11*c*, 11*d* corresponding to semiconductor lasers 12, 13 are arranged at the distal end side of the lens barrel holding portions 11*a*, 11*b*, respectively so that the beams exited from the semiconductor lasers 12, 13 are shaped into a desired suitable beam shape. Adhering portions 11*e*, 11*f* of collimator lenses 16, 17 for converting each beam that has passed the aperture portions 11*c*, 11*d* to a substantially parallel beam are arranged at two locations, respectively, in the main scanning direction at the further distal end of the lens barrel holding portions 11*a*, 11*b*. The collimator lenses 6, 7 adjust the irradiating position or the focus, and is adhered and fixed to the adhering portions 11*e*, 11*f*, similar to the collimator lenses 6, 7.

The laser holder 11 is positioned with respect to the optical case 40 similar to the laser holder 1. The positional relationship between the semiconductor lasers 12, 13 and each optical component accommodated in the optical case 40 is thereby guaranteed to be at satisfactory precision.

As shown in FIG. 2, a polygon mirror 10 serving as a rotary polygonal mirror deflection-scans the beams exited from the semiconductor lasers by rotating a motor (not shown) at a constant speed. The semiconductor lasers 2, 12 enter the polygon mirror 10 diagonally from the lower side towards the upper side at an angle θ in the sub-scanning direction, and thus are exited to the upper side at the angle θ in the sub-scanning direction when deflection-scanned by the polygon mirror 10. In other words, the lasers are the beams on the photosensitive drum side. The semiconductor lasers 3, 13, on the other hand, enter the polygon mirror 10 diagonally from the upper side towards the lower side at an angle θ in the sub-scanning direction, and thus are exited to the lower side at the angle θ in the sub-scanning direction when deflection-scanned by the polygon mirror 10. In other words, the lasers are the beams on the installing surface side. Since image exposure is performed on the photosensitive drums of the basic colors by means of the rotary polygonal mirror 10, the positional relationship between the rotary polygonal mirror 10 and each photosensitive drum is a relationship in which the photosensitive drums are arranged on both sides of the rotary polygonal mirror. In this construction, the semiconductor lasers 2, 12 and rotary polygonal mirror 10 constructs a part of a first deflection scanning unit.

A first imaging lens 21 is an fθ lens for scanning the laser light exited from the semiconductor lasers 2, 3 at constant speed and spot-imaging the same on the drum with the second imaging lenses 22, 23. The first imaging lens 21 is configured by a cylinder lens since the beams exited from the semiconductor lasers 2, 3 enter at angles different from each other. In the sub-scanning direction, the first imaging lens 21 images on the second imaging lens 22 arranged with respect to the beam of the semiconductor laser 2 and the second imaging lens 23 arranged with respect to the beam of the semiconductor laser 3. Reflecting mirrors 24 to 27 reflect the beam to a predetermined direction. The reflecting mirror 24 is arranged with respect to the beam of the semiconductor laser 2. The final reflecting mirror 25 is arranged with respect to the beam of the semiconductor laser 2. The separation reflecting mirror 26 is arranged with respect to the beam of the semiconductor laser 3, and is formed with chamfer to avoid interference with the beam of the semiconductor laser 2 when separating from the beam of the semiconductor laser 2. The final reflecting mirror 27 is arranged with respect to the beam of the semiconductor laser 3. Therefore, the beam is reflected once on the installing surface side opposite to the photosensitive drum by the reflecting mirrors 24, 26, and then reflected towards the photosensitive drum by the final reflecting mirrors 25, 27. The scanning optical device 50 thus can be arranged close to the photosensitive drum by effectively using a small space while having the beams of the semiconductor lasers 2, 3 at the same optical path length. Furthermore, after being deflection-scanned by the polygon mirror 10, the beam of the semiconductor laser 2 which is the beam on the photosensitive drum side is irradiated onto the photosensitive drum 82*a* closest to the installing surface. The positions of the reflecting mirror 24 and the final reflecting mirror 25 thus can be brought close to the photosensitive drum 82*a*. The projecting amount of the scanning optical device 50 to the installing surface side is thereby reduced, and the color printer 100 can be thinned.

The first imaging lens 31, and the second imaging lenses 32, 33 corresponding to the semiconductor lasers 12, 13 are arranged on the opposite side of the polygon mirror 10. A reflecting mirror 34 and a final reflecting mirror 35 arranged with respect to the beam of the semiconductor laser 12, and a separation reflecting mirror 36 and a final reflecting mirror 37 arranged with respect to the beam of the semiconductor laser 13 are further arranged on the opposite side of the polygon mirror 10. Therefore, the beam is reflected once on the installing surface side opposite to the photosensitive drum by the reflecting mirrors 34, 36, and then reflected towards the photosensitive drum by the final reflecting mirrors 35, 37. The scanning optical device 50 thus can be arranged close to the photosensitive drum by effectively using a small space while having the beam of the semiconductor lasers 12, 13 at the same optical path length. After being deflection-scanned by the polygon mirror 10, the beam of the semiconductor laser 3 which is the beam on the installing surface side is irradiated onto the photosensitive drum 82*d* farthest from the installing surface. The beam of the semiconductor laser 2 is thus on the photosensitive member side with respect to the beam of the semiconductor laser 3 after being deflection-scanned by the polygon mirror 10. When reflecting the beam once by the reflecting mirror 34 towards the installing surface side opposite to the photosensitive drum, the chamfer for preventing interference with the beam of the semiconductor laser 2 does not need to be formed in the reflecting mirror 34. The cost is thus reduced compared to when the imaging optical units 21 to 27 are symmetric to the polygon mirror 10.

An upper lid 41 is attached to the optical case 40 to tightly seal the scanning optical device 50 and to prevent dust, toner or the like from entering the scanning optical device 50. An opening of a slit-form is formed in the upper lid 41 at positions corresponding to photosensitive drums 82*a*, 82*b*, 82*c*, and 82*d*, and dust proof glasses 43*a*, 43*b*, 43*c*, 43*d*, which are transparent members, are attached thereto. The scanning light can be irradiated to each photosensitive drum 82*a*, 82*b*, 82*c*, and 82*d* through the dust proof glasses 43*a*, 43*b*, 43*c*and 43*d*, and dust, toner or the like are prevented from entering the scanning optical device 50.

In the scanning optical device 51, the incident optical system is similar to the scanning optical device 50, and semiconductor lasers 2 and 3 serving as light sources, and collimator lenses 6 and 7 are arranged in the laser holder 1.

As shown in FIG. 3, the optical case 70 accommodates each optical component of the scanning optical device. A fit-in hole portion and a long hole portion for positioning the laser holder 1 are formed in the sub-scanning direction at the side wall of the optical case 70, similar to the optical case 40, and the positioning of the laser holder 1 with respect to the optical case 70 is similarly performed. The positional relationship between the semiconductor lasers 2, 3 and each optical component stored in the optical case 70 is thereby guaranteed to be at satisfactory precision.

A polygon mirror 60 deflection-scans the beams exited from the semiconductor lasers by rotating a motor (not shown) at a constant speed, the polygon mirror 60 being the same component as the polygon mirror 10. The semiconductor laser 2 enters the polygon mirror 60 diagonally from the lower side towards the upper side at an angle θ in the sub-scanning direction, and thus is exited to the upper side at the angle θ in the sub-scanning direction when deflection-scanned by the polygon mirror 60. In other words, the laser becomes the beam on the discharge tray 99 side. The semiconductor laser 3, on the other hand, enters the polygon mirror 60 diagonally from the upper side towards the lower side at an angle θ in the sub-scanning direction, and thus is exited to the lower side at the angle θ in the sub-scanning direction when deflection-scanned by the polygon mirror 60. In other words, the lasers become the beams on the installing surface side. In this construction, the semiconductor lasers 3, 13 and rotary polygonal mirror 60 constructs a part of a second deflection scanning unit. And the image forming means 81LC and an image forming means 81LM are a first image forming means and the second image forming means, respectively.

A first imaging lens 61 is an fθ lens for constant speed scanning the laser light exited from the semiconductor lasers 2, 3 and spot imaging the same on the drum with the second imaging lenses 62, 63. The first imaging lens 61 is the same component as the first imaging lenses 21, 31, and the second imaging lenses 62, 63 are the same components as the second imaging lenses 22, 23, 32, 33. The reflecting mirrors 64 to 66 reflect the beam to a predetermined direction. The reflecting mirror 64 is arranged with respect to the beam of the semiconductor laser 2. The final reflecting mirror 65 is arranged with respect to the beam of the semiconductor laser 2. The final reflecting mirror 66 is arranged with respect to the beam of the semiconductor laser 3. Therefore, since the beam of the semiconductor laser 3 is reflected only once by the final reflecting mirror 66, enlargement in the vertical direction is suppressed, thereby achieving thinning. In particular, the final reflecting mirror 66 for reflecting the beam only once is arranged on the back end side of the paper discharged to the discharge tray 99 of the upper surface of the apparatus. The depth on the back end side of the paper of the discharge tray 99 can be made deep, and the color printer 100 can be thinned while ensuring the stacking number of papers and the stacking property. The beam of the semiconductor laser 2 is reflected once towards the front end side of the paper of the discharge tray 99 opposite to the photosensitive drum by the reflecting mirror 64, and then reflected towards the photosensitive drum by the final reflecting mirror 65. The scanning optical device 51 thus can be arranged close to the photosensitive drum by effectively using the small space while having the beams of the semiconductor lasers 2, 3 at the same optical path length, thereby achieving thinning. Furthermore, after being deflection-scanned by the polygon mirror 60, the beam of the semiconductor laser 3 which is the beam on the photosensitive drum side is irradiated onto the photosensitive drum 82*f* close to the installing surface. The position of the final reflecting mirror 66 thus can be brought close to the photosensitive drum 82*f*. The projecting amount of the scanning optical device 51 to the discharge tray 99 side is thereby reduced, and the color printer 100 can be made thinner.

An upper lid 71 is attached to the optical case 70 to tightly seal the scanning optical device 51 and to prevent dust, toner or the like from entering the scanning optical device 51. An opening of a slit-form is formed in the bottom surface of the optical case 70 at positions corresponding to photosensitive drums 82*e*, and 82*f*, and dust proof glasses 72*e*, 72*f*, which are transparent members, are attached thereto. The scanning light can be irradiated to each photosensitive drum 82*e*, 82*f* through the dust proof glasses 72*e*, 72*f*, but dust, toner or the like are prevented from entering the scanning optical device 51. The interval between the photosensitive drums 82*e*, 82*f* on the upper side of the intermediate transfer belt 87 is wider than the intervals among the photosensitive drums 82*a*, 82*b*, 82*c*, 82*d* on the lower side of the intermediate transfer belt 87. Thus, the spacing of the dust proof glasses 72*e*, 72*f* is also made wide, whereby a wide area can be ensured between the dust proof glasses 72*e*, 72*f* at a stay (not shown) for attaching the scanning optical device 51. The strength of the stay is sufficiently ensured, and vibration of the scanning optical device 51 is suppressed, and furthermore, the rigidity of the color printer 100 is maintained.

The flow until the beams exited from the semiconductor lasers 2, 3, 12, 13 are irradiated to each photosensitive drum 82*a*, 82*b*, 82*c*, 82*d* as scanning lights E1, E2, E3, E4 in the scanning optical device 50 will now be described.

The beams exited from the semiconductor lasers 2, 3 have the size of the beam cross section limited by the apertures 1*c*, 1*d* of the laser holder 1, are converted to substantially parallel beams by the collimator lenses 6, 7, and directed to the cylindrical lens (not shown). Of beams entered into the cylindrical lens, the beam in the main scanning cross section is transmitted in the relevant state, whereas the beam in the sub-scanning cross section is converged and imaged as a substantially linear image on the same surface of the polygon mirror 10. In this case, the beams enter diagonally so as to intersect in the vicinity of the polygon mirror 10 at an angle θ in the sub-scanning direction. The beams exit at the angle θ in the sub-scanning direction while being deflection-scanned by the polygon mirror 10 through rotation. Of the two beams exited from the polygon mirror 10, the beam exited from the semiconductor laser 2 is received by a BD sensor (not shown). The BD sensor detects the beam exited from the semiconductor laser 2, outputs a synchronous signal, and adjusts the timing of scanning start position on the end of the image by the semiconductor lasers 2, 3. Since the semiconductor lasers 2, 3 are arranged in one laser holder 1 in the sub-scanning direction, the timing of the scanning start position on the end of the image by the semiconductor laser 3 becomes the same timing as for the semiconductor laser 2. The beams timing-adjusted and exited from the semiconductor lasers 2, 3 are transmitted through the first imaging lens 21. Subsequently, the beam exited from the semiconductor laser 2 is reflected to the lower side by the reflecting mirror 24, transmitted through the second imaging lens 22, reflected by the final reflecting mirror 25, transmitted through the dust proof glass 43*a* and irradiated onto the photosensitive drum 82*a* as scanning light E1. The beam exited from the semiconductor laser 3, on the other hand, is reflected to the lower side by the separation reflecting mirror 26, transmitted through the second imaging lens 23, reflected by the final reflecting mirror 27, transmitted through the dust proof glass 43*b* and irradiated onto the photosensitive drum 82*b* as scanning light E2.

The beams exited from the semiconductor lasers 12, 13 have the size of the beam cross section limited by the apertures 11*c*, 11*d* of the laser holder 11, are converted to substantially parallel beams by the collimator lenses 16, 17, and directed to the cylindrical lens (not shown). Of the beams entered into the cylindrical lens, the beam in the main scanning cross section is transmitted in the relevant state, whereas the beam in the sub-scanning cross section is converged and imaged as a substantially linear image on the same surface of the polygon mirror 10. In this case, the beams enter diagonally so as to intersect in the vicinity of the polygon mirror 10 at an angle θ in the sub-scanning direction. The beams exit at the angle θ in the sub-scanning direction while being deflection-scanned by the polygon mirror 10 through rotation. Of the two beams exited from the polygon mirror 10, the beam exited from the semiconductor laser 12 and reflected towards the polygon mirror 10 is received by a BD sensor (not shown). The BD sensor detects the beam exited from the semiconductor laser 12, outputs a synchronous signal, and adjusts the timing of scanning start position on the end of the image by the semiconductor lasers 12, 13. Since the semiconductor lasers 12, 13 are arranged in one laser holder 11 in the sub-scanning direction, the timing of the scanning start position on the end of the image by the semiconductor laser 13 has the same timing as for the semiconductor laser 12. The beams timing-adjusted and exited from the semiconductor lasers 12, 13 are transmitted through the first imaging lens 31. Subsequently, the beam exited from the semiconductor laser 12 is reflected to the lower side by the separation reflecting mirror 34, transmitted through the second imaging lens 32, reflected by the final reflecting mirror 35, transmitted through the dust proof glass 43*c* and irradiated onto the photosensitive drum 82*c* as scanning light E3. The beam exited from the semiconductor laser 13, on the other hand, is reflected to the lower side by the reflecting mirror 36, transmitted through the second imaging lens 33, reflected by the final reflecting mirror 37, transmitted through the dust proof glass 43*d* and irradiated onto the photosensitive drum 82*d* as scanning light E4.

The flow until the beams exited from the semiconductor lasers 2, 3 are exposed on each photosensitive drum 82*e*, 82*f* as scanning lights E5, E6 in the scanning optical device 51 will now be described.

The beams exited from the semiconductor lasers 2, 3 have the size of the light flux cross section limited by the apertures 1*c*, 1*d* of the laser holder 1, are converted to substantially parallel beams by the collimator lenses 6, 7, and directed to the cylindrical lens (not shown). Of the beams directed into the cylindrical lens, the beam in the main scanning cross section is transmitted in the relevant state, whereas the beam in the sub-scanning cross section is converged and imaged as a substantially linear image on the same surface of the polygon mirror 60. In this case, the beams enter diagonally so as to intersect in the vicinity of the polygon mirror 60 at an angle θ in the sub-scanning direction. The beams exit at the angle θ in the sub-scanning direction while being deflection-scanned by the polygon mirror 60 through rotation. Of the two beams exited from the polygon mirror 60, the beam exited from the semiconductor laser 2 is received by a BD sensor (not shown). The BD sensor detects the beam exited from the semiconductor laser 2, outputs a synchronous signal, and adjusts the timing of scanning start position on the end of the images by the semiconductor lasers 2, 3. Since the semiconductor lasers 2, 3 are arranged in one laser holder 1 in the sub-scanning direction, the timing of the scanning start position on the end of the image by the semiconductor laser 3 has the same timing as for the semiconductor laser 2. The beams which are timing-adjusted and exited from the semiconductor lasers 2, 3 are transmitted through the first imaging lens 61. Subsequently, the beams exited from the semiconductor laser 2 is reflected to the upper side by the reflecting mirror 64, transmitted through the second imaging lens 62, reflected by the final reflecting mirror 65, transmitted through the dust proof glass 72*e*and irradiated onto the photosensitive drum 82*e* as scanning light E5. The beam exited from the semiconductor laser 3, on the other hand, is transmitted through the second imaging lens 63, reflected by the final reflecting mirror 66, transmitted through the dust proof glass 72*f* and irradiated onto the photosensitive drum 82*f* as scanning light E6. The positional relationship between the rotary polygonal mirror 60 and each photosensitive drum of the present embodiment is the relationship in which the photosensitive drums are collected to one side with respect to the rotary polygonal mirror 60. The optical path length from the rotary polygonal mirror to the photosensitive drum is ensured, and thus the optical path from the rotary polygonal mirror 60 to the photosensitive drum on the farthest side can be made to be an optical path in which the laser is not reflected in the direction of moving away from the photosensitive drum.

The operation of performing image formation in the color printer 100 will now be described.

When a print start signal is input, the laser beam is irradiated as scanning light from the scanning optical device 50 to each photosensitive drum 82*a*, 82*b*, 82*c*, 82*d*, 82*e*, 82*f* based on image information. The description until the laser beam is irradiated is the same as the description for the flow until the beams exited from the semiconductor lasers 2, 3, 12, 13 are irradiated on each photosensitive drum 82*a*, 82*b*, 82*c*, 82*d*, 82*e*, 82*f* as scanning light E1, E2, E3, E4, E5, E6 is the same as described above, and thus description thereof will not be repeated. In image formation, each photosensitive drum 82*a*, 82*b*, 82*c*, 82*d*, 82*e*, 82*f* is exposed. The electrostatic latent image is thereby formed on each photosensitive drum 82*a*, 82*b*, 82*c*, 82*d*, 82*e*, 82*f* charged by the primary chargers 83*a*, 83*b*, 83*c*, 83*d*, 83*e*, 83*f*. Subsequently, the friction electrified toner of each color is attached to the electrostatic latent image in the developing devices 84*a*, 84*b*, 84*c*, 84*d*, 84*e*, 84*f* thereby forming the toner image on each 82*a*, 82*b*, 82*c*, 82*d*, 82*e*, 82*f*. The toner image is transferred from each photosensitive drum 82*a*, 82*b*, 82*c*, 82*d*, 82*e*, 82*f* onto the intermediate transfer belt 87 at each primary transfer nip portion. The transfer paper is fed one at a time from the sheet cassette 92 by the sheet feeding roller 93, conveyed to the registration roller pair 94, stopped once, and then again conveyed at a timing the toner image is transferred to a predetermined position at the secondary transfer portion. In the secondary transfer portion, the image is formed on the transfer paper by again transferring the toner image to the transfer paper from above the intermediate transfer belt 87. The transfer paper formed with the image is fixed with the toner image with heat by the fixing portion 95, and conveyed and discharged to the discharge tray 99 through the conveyance roller pairs 96, 97 and the discharge roller pair 98.

As described above, the adjacent image forming portions are arranged in a superimposed manner in a range the exposure of the photosensitive member is not inhibited so as to have the intervals among the photosensitive drums 82*a*, 82*b*, 82*c*, and 82*d* arranged on the lower side of the intermediate transfer belt as small as possible. Specifically, the developing devices 84*a*, 84*b*, 84*c*, and 84*d* are arranged so as to be partially superimposed in the vertical direction on the lower side of the primary chargers 83*a*, 83*b*, 83*c*, and 83*d*. The occupying space of the image forming portion thus does not enlarge in the left and right width direction, and the color printer 100 can be miniaturized. The interval between the photosensitive drums 82*e*, 82*f* arranged on the upper side of the intermediate transfer belt is made wider than the interval of the photosensitive drums 82*a*, 82*b*, 82*c*, 82*d* arranged on the lower side of the intermediate transfer belt. The primary chargers 83*e*, 83*f* and the developing devices 84*e*, 84*f* are thus arranged so as not to be superimposed in the vertical direction. The occupying space of the image forming portion thus does not enlarge in the vertical height direction, and the color printer 100 can be miniaturized. Furthermore, the scanning optical device 51 can be arranged close to the photosensitive drums 82*e*, 82*f* and the degree of freedom of arrangement can be enhanced, whereby the color printer 100 can be further miniaturized without being enlarged in the vertical height direction.

Since the interval between the photosensitive drums 82*e*, 82*f* is made wide, the interval of the dust proof glasses 72*e*, 72*f* of the scanning optical device 51 is also made wide, whereby a wide area can be ensured between the dust proof glasses 72*e*, 72*f* at a stay (not shown) for attaching the scanning optical device 51. The strength of the stay is sufficiently ensured, and vibration of the scanning optical device 51 is suppressed, and furthermore, the rigidity of the color printer 100 is maintained.

Furthermore, since the beam of the semiconductor laser 3 of the scanning optical device 51 is reflected only once at the final reflecting mirror 66, enlargement in the vertical direction is suppressed, thereby achieving a thinner apparatus. In particular, the final reflecting mirror 66 for reflecting the beam only once is arranged on the back end side of the paper discharged to the discharge tray 99 of the upper surface of the apparatus. The depth on the back end side of the paper of the discharge tray 99 can be made deep, and the color printer 100 can be thinned while ensuring the stacking number of papers and the stacking property. The beam of the semiconductor laser 2 is reflected once towards the front end side of the paper of the discharge tray 99 opposite to the photosensitive drum by the reflecting mirror 64, and then reflected towards the photosensitive drum by the final reflecting mirror 65. The scanning optical device 51 thus can be arranged close to the photosensitive drum by effectively using the small space while having the beams of the semiconductor lasers 2, 3 at the same optical path length, thereby achieving a thinner apparatus.

Furthermore, the optical paths of the semiconductor lasers 2, 3 of the scanning optical device 51 are arranged with the optical axes inclined so as to intersect with each other in the vicinity of the polygon mirror at a predetermined angle θ in the sub-scanning direction, and the beam of the semiconductor laser 3 which is the beam on the photosensitive drum side is irradiated onto the photosensitive drum 82*f* close to the installing surface after being deflection-scanned by the polygon mirror 60. The position of the final reflecting mirror 66 thus can be brought close to the photosensitive drum 82*f*, whereby the projecting amount of the scanning optical device 51 to the discharge tray 99 side is reduced, and the color printer 100 can be made thin.

Moreover, the optical paths of the semiconductor lasers 2, 3 and the semiconductor lasers 12, 13 of the scanning optical device 50 are arranged with the optical axis inclined so as to intersect with each other in the vicinity of the polygon mirror 10 at a predetermined angle θ in the sub-scanning direction. The beam on the photosensitive drum 82*a* closest to the installing surface of the color printer 100 thus approaches the photosensitive member side after being deflected at the polygon mirror 10, whereby the reflecting mirror 24 and the final reflecting mirror 25 can be arranged closer to the photosensitive drum 82*a*. The projection of the scanning optical device 50 towards the installing surface side is thereby suppressed, and the color printer 100 is miniaturized without being further enlarged in the vertical height direction.

The contacting parts of the photosensitive drums 82*a*, 82*b*, 82*c*, 82*d* on the lower side of the intermediate transfer belt and the intermediate transfer belt are formed. The distance between the contacting parts in the adjacent photosensitive drums is set to be substantially the same as the peripheral length of the photosensitive drum. In the present embodiment, the peripheral lengths of all the photosensitive drums are the same, but the distance between the contacting parts is substantially the same as the peripheral length of the photosensitive drum on the upstream side in the moving direction of the intermediate transfer belt. The distance between the contacting parts of the photosensitive drums 82*e*, 82*f* on the upper side and the intermediate transfer belt are set to be substantially an integral multiple of the peripheral length of one of the photosensitive drums 82*a*, 82*b*, 82*c*, 82*d* on the lower side. The peripheral length of the photosensitive drums of three colors of magenta, cyan, and yellow are preferably the same peripheral length, and the distance between the contacting parts of the photosensitive drums 82*e*, 82*f* on the upper side and the intermediate transfer belt is substantially an integral multiple of the relevant peripheral length. The influence of rotation unevenness caused by the drum, which is one cause of production of color shift, is eliminated, the color shift is reduced, and higher image quality is achieved.

A single laser having one light emitting point in one housing is used for the semiconductor lasers 2, 3, 12, 13, but is not limited thereto. For example, a semiconductor laser having a plurality of light emitting points in one housing may be used, in this case, the number of scanning lines for scanning the photosensitive drums also increases proportionally, and thus is suited for high-speed writing.

A configuration of diagonally entering the optical paths of the semiconductor lasers 2, 3 and the semiconductor lasers 12, 13 with the optical axis inclined so as to intersect with each other in the vicinity of the polygon mirror 10 at a predetermined angle θ in the sub-scanning direction is adopted. However, the present invention is not limited thereto, and a configuration of entering the optical paths in parallel without forming an angle in the sub-scanning direction may be adopted. In this case, however, the beam deflected at the polygon mirror 10 or the polygon mirror 60 is scanned parallel with the photosensitive drum, and thus the reflecting mirror can be arranged closer to the photosensitive drum with the configuration of entering the light diagonally. The projection of the scanning optical device 50 or 51 in the height direction is thereby suppressed, and the color printer 100 is miniaturized without being further enlarged in the vertical height direction.

Six image forming portions are used in the above described embodiment, but the numbers to be used are not limited thereto, and may be appropriately set as necessary. For example, an embodiment in which a transparent toner, sometimes referred to as a white toner in addition to the light magenta and the light cyan are used, can be employed. The example is described with the upper surface side of the device as one surface side and the bottom surface of the device as the other surface side of the intermediate transfer belt, but is not limited thereto. Two image forming portions are arranged on the one surface side and four image forming portions are arranged on the other surface side, but is not limited thereto. The number of image forming portions only needs to be fewer on the one surface side which is the upper surface side of the device than the other surface side which is the bottom surface of the device. For example, a seven color configuration using light magenta, light cyan and a transparent toner can be employed. In such case, the four colors of yellow, magenta, cyan and black are arranged on the same transfer belt surface between the first and second suspending members. The image forming portions of light magenta and light cyan may be arranged on the other surface between the first and second suspending members, or the image forming portions of light magenta, light cyan and transparent toner may be arranged on the other surface between the first and second suspending members.

In the present embodiment, the intervals of the image bearing member of basic colors are set to be all equal. However, the intervals of the image bearing members of magenta, cyan and yellow, and the interval between black and the adjacent image bearing members differ in a configuration in which only the image bearing member of black is enlarged. In this case, the minimum distance of the spacing between the adjacent image bearing members on the basic color side and the minimum distance of the spacing between the adjacent image bearing members on the accessory color side are simply compared. The effects of the present invention are obtained if the minimum distance for the accessory color side is larger.

Figure 6:
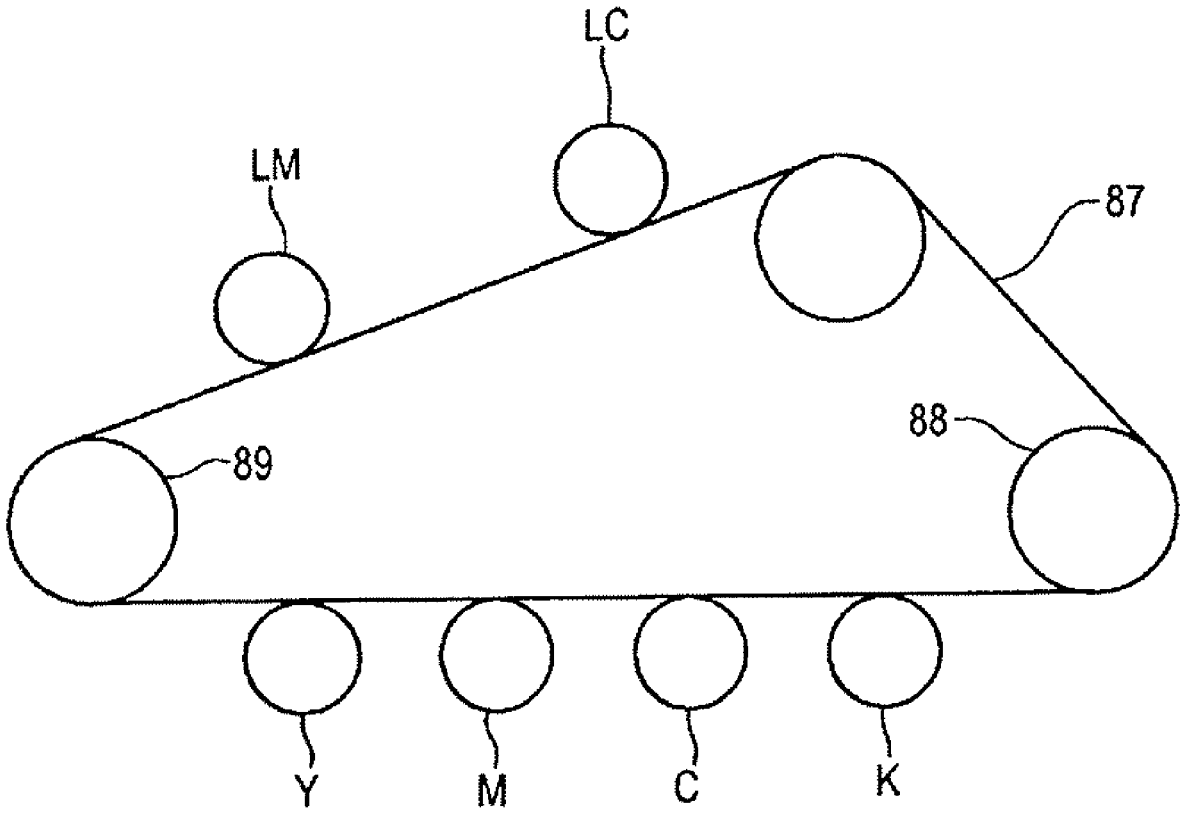
FIG. 6 is an arrangement diagram of three suspending members.

Two suspending members are used in the present embodiment, but a configuration of using three suspending members is shown in FIG. 6. Yellow (Y), magenta (M), cyan (C), and black (K) are arranged on the same transfer belt surface between two suspending members (88, 89). Light magenta (LM) and light cyan (LC) are arranged on the other belt surface between the two suspending members (88, 89). Similar effects are still obtained even with such configuration by using the configuration of the present invention.

A printer has been described as an image forming apparatus in the embodiment described above, but the present invention is not limited thereto, and maybe other image forming apparatuses such as copying machine or facsimile, or complex machine combining the above functions.

An image forming apparatus including toners of specific colors is provided according to the present invention, where the height of the image forming apparatus is reduced even with a configuration of lining the basic colors on one surface of the belt member by enhancing the degree of freedom of arrangement of the image forming portions of the accessory color.

The embodiment of the present invention has been described, but the present invention should not in any way be limited to the above embodiments, and various modifications may be made possible within the scope of the present invention.

This application claims the benefit of priority from the prior Japanese Patent Application No. 2006-120074 filed on Apr. 25, 2006 the entire contents of which are incorporated by reference herein.

What is claimed is:

1. An image forming apparatus comprising:

a first image forming portions group including a plurality of image forming portions, which develops latent images on a plurality of image bearing members, respectively, with toners including yellow toner, magenta toner, cyan toner and black toner, a second image forming portions group including a plurality of image forming portions, which develops latent images on a plurality of image bearing members, respectively, with toners having colors different from yellow toner, magenta toner, cyan toner and black toner, an intermediate transfer belt on which images formed by the first image forming portions group and the second image forming portions group are transferred;

tension members between which the intermediate transfer belt is stretched, wherein toner images formed by the first image forming portions group are transferred to a first belt face between the tension members, and toner images formed by the second image forming portions group are transferred to a second belt face between the tension members, wherein the number of the image bearing members facing the second belt face is smaller than the number of the image bearing members facing the first belt face, and the interval between neighboring image bearing members facing the second belt face is larger than interval between neighboring image bearing member facing the first belt face; and a first exposing member having a plurality of laser sources provided for the image bearing members of the second image forming portions group and a first rotary polygon mirror that scans the image bearing members of the second image forming portions group, respectively, with laser beams from the laser sources, wherein the first rotary polygon mirror is disposed at an end portion side of the second image forming portions in an aligning direction of the image bearing members of the second image forming portions group; and a second exposing member having a plurality of laser sources provided for the plurality of image bearing members of the first image forming portions group and a second rotary polygon mirror that scans the image bearing members of the first image forming portions group, respectively, with laser beams from the plurality of laser sources of the second exposing member, wherein the plurality of image bearing members of the first image forming portions group are disposed at both sides of an axis of the second rotary polygon mirror.

2. The image forming apparatus according to claim 1, wherein each of the plurality of the image forming portions in the first image forming portions group partly overlaps with a neighboring image forming portion in vertical direction on a belt face of the intermediate transfer belt moving from a first winding member to a second winding member.

3. The image forming apparatus according to claim 1, wherein each of the plurality of the image forming portions in the second image forming portions group is disposed so as not to overlap with a neighboring image forming portion respectively in a vertical direction on a belt face of the intermediate transfer belt moving from a second winding member to a first winding member.

4. The image forming apparatus according to claim 1, wherein neighboring image transfer positions for transferring toner images on the plurality of image bearing members to the intermediate transfer belt in the first image forming group are arranged at an equal distance therebetween.

5. The image forming apparatus according to claim 4, wherein the circumferential length of each of the plurality of image bearing members in the first image forming portions group is equal to the circumferential length of each of the other image bearing members in the first image forming portions group, and wherein the circumferential length of each of the plurality of image bearing members in the first image forming portions group is equal to the distance between neighboring transfer positions of the plurality of image bearing members.

6. The image forming apparatus according to claim 1, wherein the distance between neighboring image transfer positions where toner on the plurality of image bearing members is transferred to the intermediate transfer belt in the second image forming portions group is longer than the distance between neighboring image transfer positions in the first image forming portions group.

7. The image forming apparatus according to claim 6, wherein the distance between neighboring image transfer positions where toner on the plurality of image bearing members is transferred to the intermediate transfer belt in the second image forming portions group is an integral multiple of the distance between neighboring image transfer positions in the first image forming portions group.

8. The image forming apparatus according to claim 3, wherein the distance between neighboring image transfer positions where toner on the plurality of image bearing members is transferred to the intermediate transfer belt in the second image forming portions group is longer than the distance between neighboring image transfer positions in the first image forming portions group.

9. The image forming apparatus according to claim 8, wherein the distance between neighboring image transfer positions where toner on the plurality of image bearing members is transferred to the intermediate transfer belt in the second image forming portions group is longer than the distance between neighboring image transfer positions in the first image forming portions group.

* * * * *